US010598057B2

(12) United States Patent
Lach et al.

(10) Patent No.: US 10,598,057 B2
(45) Date of Patent: Mar. 24, 2020

(54) OIL SUPPLY CIRCUIT OF AN ENGINE

(71) Applicant: Ford Global Technologies, LLC, Dearborn, MI (US)

(72) Inventors: Rainer Lach, Wuerselen (DE); Franz Weber, Sinzig (DE); Frank Wunderlich, Herzogenrath (DE); Joerg Kemmerling, Monschau (DE); Guenter Hans Grosch, Vettweiss (DE); Joerg Bonse, Wuerselen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 383 days.

(21) Appl. No.: 15/413,319

(22) Filed: Jan. 23, 2017

(65) Prior Publication Data

US 2017/0218801 A1 Aug. 3, 2017

(30) Foreign Application Priority Data

Jan. 29, 2016 (DE) ..... 10 2016 201 414

(51) Int. Cl.

| | |
|---|---|
| ***F01M 11/02*** | (2006.01) |
| ***F01M 5/02*** | (2006.01) |
| ***F01M 1/02*** | (2006.01) |
| ***F01M 11/00*** | (2006.01) |

(52) U.S. Cl.

CPC ..... *F01M 11/02* (2013.01); *F01M 1/02* (2013.01); *F01M 5/025* (2013.01); *F01M 11/0004* (2013.01); *F01M 2011/0033* (2013.01); *F01M 2011/023* (2013.01)

(58) Field of Classification Search

CPC F01L 2810/02; F01M 11/02; F01M 2011/023

See application file for complete search history.

(56) References Cited

U.S. PATENT DOCUMENTS

| | | | | |
|---|---|---|---|---|
| 3,824,973 | A | 7/1974 | Harhaus | |
| 6,823,825 | B1 | 11/2004 | Hwang et al. | |
| 8,887,704 | B2 * | 11/2014 | Spix | F01M 13/04 123/572 |
| 2008/0135003 | A1 | 6/2008 | Lee | |
| 2013/0133598 | A1 * | 5/2013 | Yamane | F01L 1/34 123/90.17 |

(Continued)

FOREIGN PATENT DOCUMENTS

| | | | |
|---|---|---|---|
| DE | 19619183 | C1 | 7/1997 |
| DE | 112007001074 | T5 | 4/2009 |

(Continued)

*Primary Examiner* — Long T Tran

(74) *Attorney, Agent, or Firm* — Geoffrey Brumbaugh; McCoy Russell LLP

(57) ABSTRACT

Methods and systems are provided for an internal combustion engine having an oil circuit. In one example, a system may include a rising oil line from a block to a cylinder head of an engine; a main oil line in the head; and an oil siphon system including a reservoir positioned between, and having at least one portion at a lower elevation than both, a section the rising line and a section of the main oil line so that oil flows into, and remains in, the reservoir when the engine is shut-off. In this way, the design of the oil circuit may be used to improve oil supply to engine components while minimizing delays in oil supply during engine startup.

19 Claims, 2 Drawing Sheets

(56) References Cited

U.S. PATENT DOCUMENTS

| | | | | |
|---|---|---|---|---|
| 2015/0128889 | A1* | 5/2015 | Konishi | F01L 1/3442 123/90.15 |
| 2015/0226328 | A1 | 8/2015 | Horie et al. | |
| 2015/0369098 | A1* | 12/2015 | Barnes | F02F 1/24 123/193.5 |

FOREIGN PATENT DOCUMENTS

| | | | |
|---|---|---|---|
| DE | 102009045320 | A1 | 4/2011 |
| DE | 102012216258 | A1 | 5/2013 |
| DE | 102013100018 | A1 | 7/2013 |
| DE | 102013209169 | A1 | 11/2013 |
| EP | 2133532 | A2 | 12/2009 |

* cited by examiner

OIL SUPPLY CIRCUIT OF AN ENGINE

CROSS REFERENCE TO RELATED APPLICATION

The present application claims priority to German Patent Application No. 102016201414.5, filed on Jan. 29, 2016. The entire contents of the above-referenced application are hereby incorporated by reference in its entirety for all purposes.

FIELD

The present description relates generally to methods and systems for an oil supply circuit for an internal combustion engine.

BACKGROUND/SUMMARY

When an engine is operated in an idle mode, oil pressure in an oil circuit supplying oil to various engine components, may decrease substantially. Consequently, the oil pressure in the oil circuit may also decrease substantially, and the oil circuit may not reliably supply oil or provide adequate oil pressure to various engine components such as a hydraulic actuating device of a switchable valve drive. When the engine is switched off, the oil pressure in the oil circuit may fall abruptly, and the oil in the circuit may drain via gravity through a return oil line to oil pan.

The engine may be switched off for various reasons, such as when parking the vehicle, for example. However, switching off the engine may also take place during a start-stop strategy, in which the engine is switched off when there is no current power requirement, rather than continuing to operate the engine at idle. In practice, this means that the engine is deactivated, i.e. unpowered, at least when the vehicle is at a standstill.

If the engine is started or restarted, there is need to increase the oil pressure in the oil circuit. In addition, some of the lines in the oil circuit, which have emptied owing to the engine being switched off, must be refilled with oil before the oil pressure in these lines may be increased. These processes take time, typically a few seconds, especially lines in the oil circuit which are geodetically at higher points may be severely affected, such as oil lines in the cylinder head, e.g. a rising line leading into the cylinder head and a main oil line extending in the cylinder head. Consequently, the engine components receiving engine oil from these lines may not receive engine oil or adequate oil pressure in a timely manner, especially during engine start.

Attempts to address delayed supply of engine oil to various engine components include use of check valves in the oil circuit. One example approach is shown by Lee in US 2008/0135003. Therein, an oil supply circuit in an engine comprising a first and a second oil circuit for supplying engine oil to a plurality of tappets of cylinders via a hydraulic pump is disclosed. Each of the first and second oil circuit is configured with a control valve to control flow of oil in each circuit. The use of check valves in the oil circuits is designed to counteract emptying of oil lines.

However, the inventors herein have recognized potential issues with such a system. As an example, the use of check valves in the oil circuit may entail a pressure loss in the circuit, which may reduce oil pressure transmitted to engine components during engine operation. Further, check valves in the oil circuit may malfunction due to various causes, and may affect transmission of oil to various engine components.

The inventors herein have developed an oil circuit design to at least partly address the above issues. In one example design, an oil circuit may be provided comprising: a rising oil line from a block to a cylinder head of an engine; a main oil line in the head; and an oil siphon system including a reservoir positioned between, and having at least one portion at a lower elevation than both, a section of the rising line and a section of the main oil line so that oil flows into, and remains in the reservoir when the engine is shut-off. In an additional example, the rising oil line, the main oil line and the oil siphon system are a sealed system, and oil remains in the reservoir and at least a portion of the main line and a portion of the rising line after the engine is shut-off. In a further example, engine components receive oil upon engine start without an interruption in oil delivery. In another example, the oil siphon system and reservoir form essentially a u-shape connected between the rising and main oil lines, and engine components receive oil upon engine start without an interruption in oil delivery. The components include one or more of the following; a valve train, a variable valve drive, a camshaft, or a camshaft adjuster.

In this way, the design of the oil circuit may be used to improve oil supply to engine components while minimizing delays during engine startup. For example, the siphon system may reduce an abrupt drop of oil levels within the oil circuit when the engine is switched off. In this way, the oil circuit design may confer several advantages. By reducing the drop of oil levels in the oil circuit, the siphon system may provide a method of supplying engine oil to engine components during engine startup to minimize delays in engine response. Further, the oil circuit is a valve-less system that minimizes large pressure drops within the system to improve engine performance.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 1-2 are shown approximately to scale, although other relative dimensions may be used, if desired.

DETAILED DESCRIPTION

Figure 1:
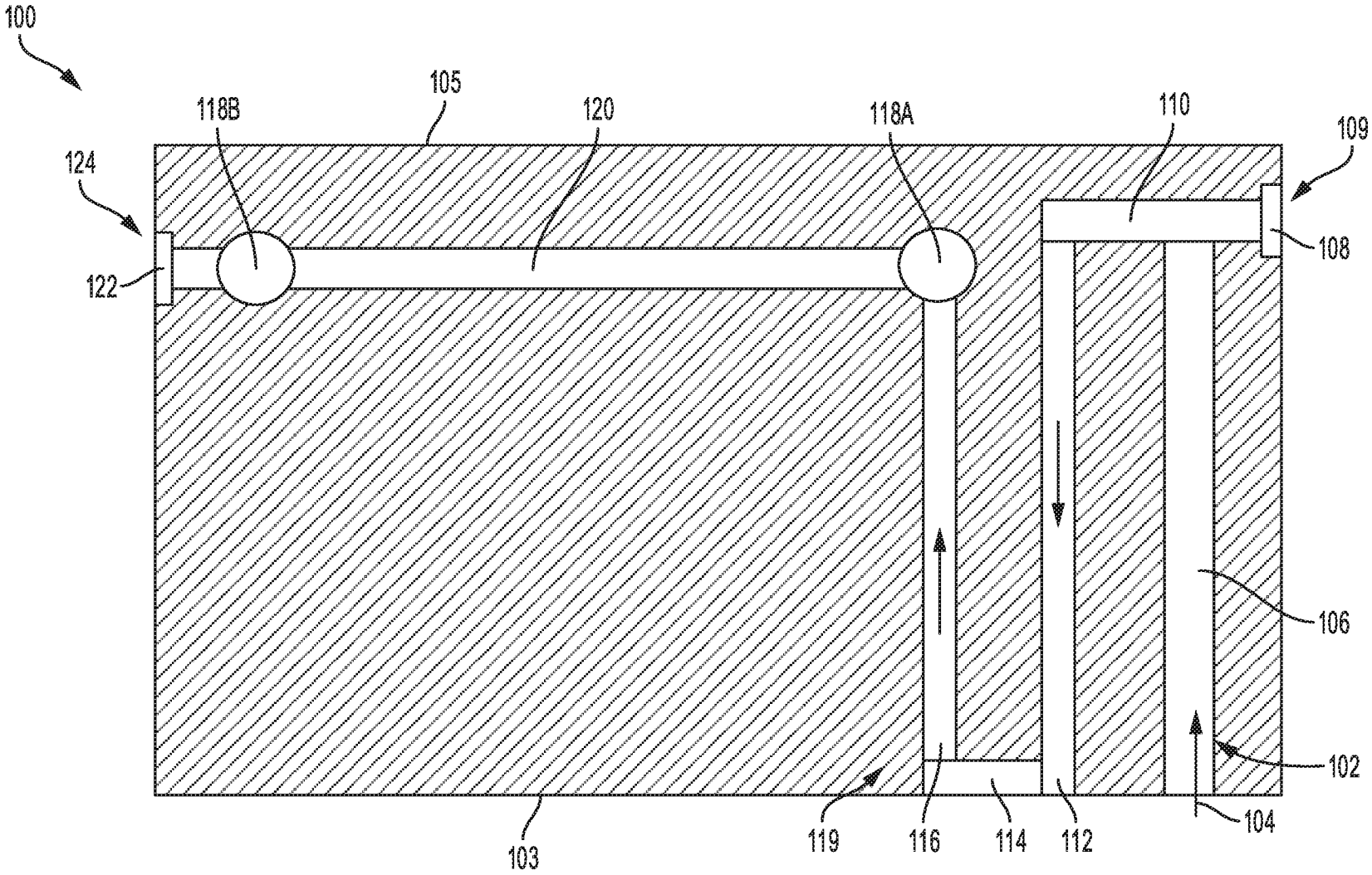
FIG. 1 shows a schematic of a section through a cylinder head of an internal combustion engine having an oil supply circuit.
Figure 2:
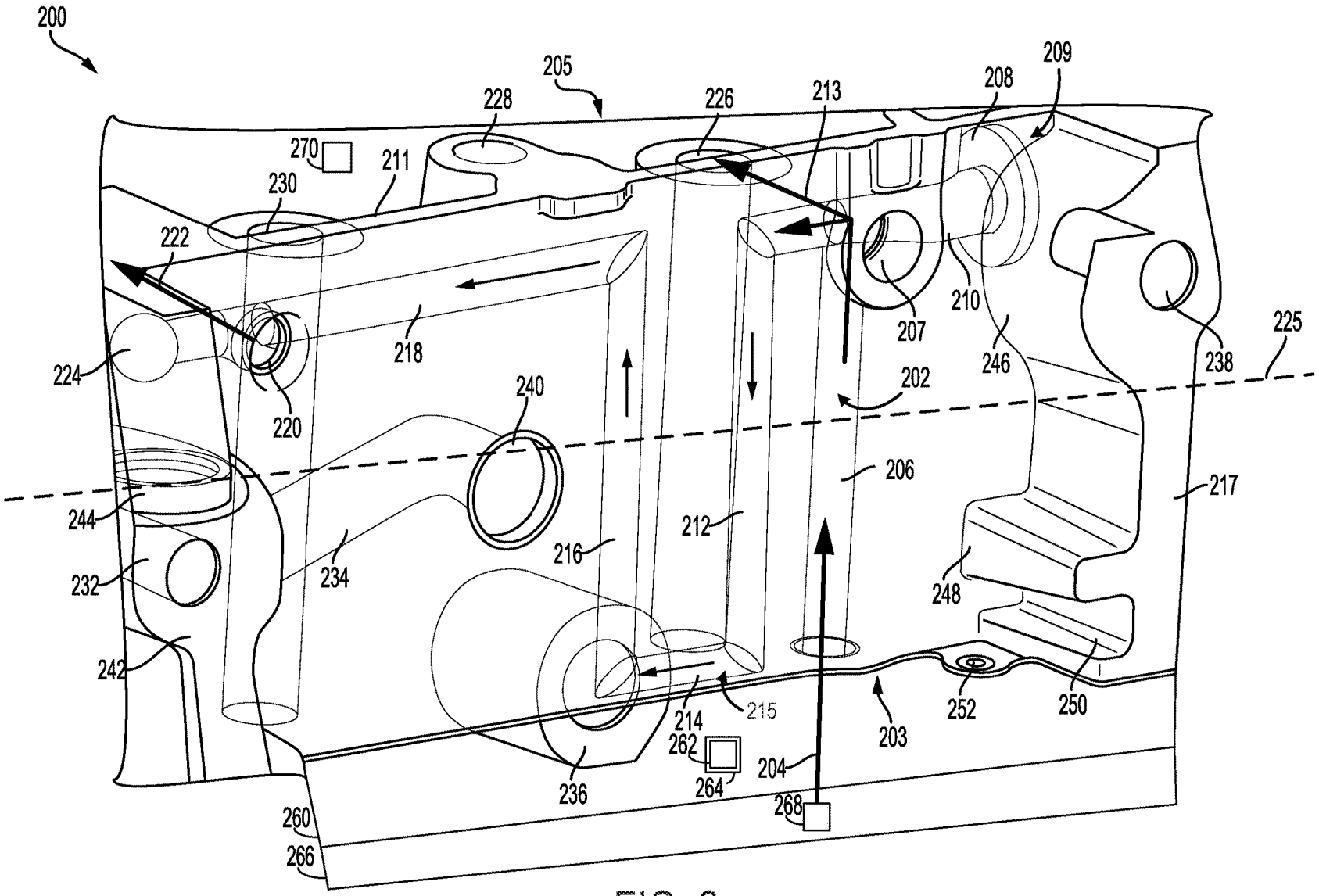
FIG. 2 shows a three dimensional schematic of an engine cylinder head having an oil supply circuit.

The following description relates to systems and methods for an oil supply circuit that may be designed to supply engine oil to a cylinder head and various components of an engine system. The oil supply circuit is formed in the cylinder head, and may be fluidly connected to engine components, such as cam shafts and cylinders, for example. As shown in FIG. 1, the oil circuit may include a rising line, a siphon system and a main oil line fluidly connected to a plurality of oil supply ducts. The oil circuit may also have a plurality of plugs connected at ends of the circuit, to form a closed oil circuit. The rising line may be a vertical passage fluidly connected to an oil pump and an oil pan containing engine oil. The rising line may be fluidly coupled to the siphon system, which in turn is fluidly coupled to the oil line. During engine operation, engine oil from the oil pan may be flowed into the rising line using the pump. The engine oil in the rising line is further conveyed to the oil line, via the siphon system, where the oil is supplied to various engine components. When the engine is switched off, the engine oil in the rising line may partially recede towards to the siphon system, which acts as an oil retention reservoir, thereby reducing an amount of oil that may drain back to the oil pan via gravity. A portion of the engine oil may be retained within the oil line, forming a continuous column of oil with a portion of oil retained in the siphon system. When the engine is restarted, the engine oil in the oil circuit may be conveyed to engine components without delay, thereby improving engine performance. A three dimensional schematic of the oil circuit is disclosed in FIG. 2. As shown in FIG. 2, the oil circuit may be fluidly coupled to oil supply ducts that may supply oil to cam shafts (not shown) mounted to the engine. The oil circuit may also be fluidly connected to the oil pump, a plurality of cylinders and other engine components.

The engine system may comprise: at least one cylinder head with at least one cylinder, a cylinder block serving as an upper crankcase half for accommodating a crankshaft in at least two bearings, the cylinder block connected to the at least one cylinder head on an assembly side; a pump for delivering engine oil to the at least two bearings, with the pump supplying engine oil via a supply line to a main oil gallery from which ducts lead to the at least two bearings, thus forming the oil circuit. As an example, the oil circuit may include the rising line which leads into the cylinder head and supplies engine oil to the main oil line of the oil circuit. The siphon system serving as an oil retention reservoir may be provided in the cylinder head between the rising line and the main oil line, with one oil line of the siphon system installed at a plane that is parallel to the assembly side of the cylinder head, with at least one section of the system positioned at geodetically lower elevation compared to a section of the rising line and geodetically lower than a section of the main oil line.

The siphon system of the oil circuit may counteract draining of engine oil from the oil lines in the oil circuit, and serve as a reservoir for engine oil when the engine is switched off. When the engine is switched off, the siphon system retains a portion of the engine oil, thereby reducing amount of engine oil that may drainage due to gravity back to an oil pan via the rising line. In this way, the oil circuit may be configured without check valves to minimize pressure losses in the engine system. When the engine is started or restarted after being switched off, the engine oil retained in the oil lines of the oil circuit, allow oil pressure in the engine system to increase without delay. In this case, engine oil retained in the oil circuit may be supplied to various engine components without delay, thereby ensuring reliable engine operation.

Since engine oil may drain by gravity when the engine is switched off, the orientation of the engine in space may be relevant. Therefore, the teaching according to the invention also refers to the installation position of the siphon system within the engine. The installation position of the siphon system may be defined with respect to an angle at which the assembly side of the cylinder head is inclined relative to a horizontal plane. According to the invention, the siphon system may have at least one section which is geodetically lower than a section of the rising line and a section of the main oil line. In preferred embodiments of the engine system, the angle associated with the installation position of siphon system may be zero. The preferred embodiment may be implemented in an in-line engine installed in a vehicle, with the orientation side of the cylinder head positioned horizontally, for example. In this way, the oil circuit in the cylinder head may provide reliable supply of oil to various engine components, thereby improving engine performance.

The pump may be a non-variable oil pump or a variable oil pump, but is preferably a non-variable oil pump, which results in cost advantages. In the case of a non-variable oil pump, a relatively high oil pressure may prevail during relatively high loads and high engine speeds, and a low oil pressure may prevail in the presence of low loads and low engine speeds. Examples of a variable oil pump, such as a vane-type pump, a piston pump, may act based on a displacement principle, however these pumps may not operate in an oscillating fashion and thus intermittently but by rotation and thus advantageously continuously.

In a vane pump, a hollow cylinder which serves as a stator and another cylinder which serves as a rotor may be configured to rotate, wherein the axis of rotation of the rotor may be eccentric with respect to the stator. In the rotor, multiple radially arranged slides may be mounted so as to be displaceable in translational fashion, which slides divide the space between the stator and rotor into multiple chambers. The delivery rate of the pump may be varied by adjusting the eccentricity of the rotor, wherein an increased delivery rate leads to an elevated oil pressure at the pump outlet. Adjusting the eccentricity may be achieved, by means of an engine controller, through the use of an electrically controllable valve, wherein the valve opens up or blocks an oil pressure line to the vane-type pump, whereby the eccentricity of the rotor is influenced.

The engine described above may be provide in a vehicle, and may include an Otto-cycle engine, a diesel engine and a hybrid engine. As an example, the hybrid engine may utilize a hybrid combustion process, and hybrid drives which may include an electric machine. The electric machine may receive power from the engine, for example. In an alternative, the electric machine may be configured as a switchable auxiliary drive which outputs electric power. The engine may include a cylinder block and at least one cylinder head which may be connected to one another on an assembly side; wherein the cylinder head may include a plurality of cylinders.

The cylinder block may have a plurality of cylinder bores to hold a plurality of pistons or cylinder liners. The piston of each cylinder may be guided in an axially movable manner in the cylinder liner. The piston and cylinder liner may form a combustion chamber of the cylinder. A piston crown forms a part of the combustion chamber inner wall, and, together with the piston rings, seals off the combustion chamber with respect to the cylinder block or the crankcase, such that no combustion gases or no combustion air passes into the crankcase, and no oil passes into the combustion chamber.

The piston serves to transmit gas forces generated by combustion of air and fuel to the crankshaft. In this case, the piston may be articulately connected by means of a piston pin to a connecting rod, which in turn is rotatably mounted to the crankshaft positioned in the crankcase. The crankshaft absorbs forces generated by the connecting rod. As an example, the forces generated by the connecting rod may include forces produced as a result of the combustion of fuel and air in the combustion chamber, and inertia forces generated as a result of the non-uniform movement of engine parts. The oscillating or reciprocating movement of the pistons is transformed into rotational movement of the crankshaft. As a result, the crankshaft may transmit torque to an engine drivetrain. A portion of the energy transmitted to the crankshaft may be used to operate auxiliary units such as the oil pump, an alternator or may be used to drive a camshaft and actuate valve drives.

Generally, and within the context of the present invention, an upper crankcase half is formed by the cylinder block. The upper crankcase is generally complemented by a lower crankcase which may be mounted on a lower portion of the upper crankcase, and may serve as an oil pan. As an example, the lower crankcase may be mounted to a flange surface of the upper crankcase. The connection is often provided by means of screws. In order to provide a tight enclosure, a seal may be positioned on the flange surface, between the upper and lower crankcases.

The crankshaft may be mounted and held by at least two bearings provided in the crankcase; wherein the bearings may be a two-part design, each having a bearing saddle and bearing cover. The crankshaft may be mounted to crankshaft journals which may be spaced apart from one another along a crankshaft axis, and may be formed as thickened shaft shoulders. The bearing covers and saddles may be formed as separate components or may be formed as one piece with the crankcase. Bearing shells may be arranged as intermediate elements between the crankshaft and the bearings.

When assembled, each bearing saddle may be connected to each corresponding bearing cover. Alternatively, each bearing saddle may be connected to the bearing cover in such a manner that allows for interaction with bearing shells as intermediate elements, forming a bore for holding the crankshaft journal. The bores are conventionally supplied with engine oil or lubricating oil, such that a load-bearing lubricating film may form between an inner surface of each bore and the associated crankshaft journal as the crankshaft rotates.

A pump may be provided to supply engine oil to the bearings in the crankshaft. As an example, the pump may supply engine oil via a supply line to a main oil gallery, from which ducts lead to the bearings in the crankshaft. A main supply duct, forming a portion of the main oil gallery, may be aligned along the longitudinal axis of the crankshaft to distribute engine oil.

As an example, the main supply duct may be arranged above or below the crankshaft in the crankcase or else integrated into the crankshaft.

As an example, the pump may be configured to provide high volume flows, thereby providing high oil pressure in the oil circuit, especially in main oil gallery. Since friction in the bearings of the crankshaft may cause the engine to consume a large amount of fuel, the bearings are adequately lubricated to minimize friction and reduce fuel consumption.

In addition to the at least two bearings of the crankshaft, other engine components need oil to properly function. The increased demand of oil by the additional engine components may affect oil pressure in the oil circuit, and may cause reduction in the oil pressure. An example component receiving oil from the oil circuit is a camshaft mounted to a camshaft receptacle. The statements made above with regard to the crankshaft bearing arrangement may apply to the camshaft as well. The camshaft receptacle may receive lubricating oil from a rising line of the oil circuit. The rising line may branch off from the main oil gallery, and extend through the cylinder block. In case of overhead camshafts, the rising line may extend into the cylinder head. The rising line supplies engine oil to a main oil line of the oil circuit extending in the cylinder head, wherein the main oil line may be fluidly coupled to various engine components.

The cylinder head conventionally serves to hold the valve drives. To control the charge exchange, the engine requires control elements and actuating devices for actuating the control elements. During the charge exchange, the combustion gases are discharged via the outlet openings and the charging of the combustion chamber takes place via the inlet openings. To control the charge exchange, in a four-stroke engine, use is made almost exclusively of lifting valves as control elements, which lifting valves perform an oscillating lifting movement to open and close inlet and outlet openings during engine operation. A valve actuating device, including the valve itself, is referred to as a valve drive, may include the camshaft, on which cams are arranged. A valve drive with overhead camshaft may, as a further valve drive component, have a rocker lever, a finger-type rocker, a tilting lever and/or a tappet. The cam follower elements may be provided between a cam and a valve.

The valve drives may be designed to open and close inlet and outlet openings of a cylinder at correct times, with a fast opening of a largest possible flow cross sections being sought in order to keep the throttling losses in inflowing and outflowing gas flows to a minimum, and in order to ensure efficient charging of the cylinder, and complete discharge of exhaust gases.

One concept for de-throttling the Otto-cycle engine includes use of at least partially variable valve drives. In contrast to conventional valve drives, where valve lift and valve timing are invariable, these parameter may be varied to a greater or lesser extent by means of variable valve drives. Valve lift and timing may have a considerable effect on the combustion process, and thus on fuel consumption. If the valve drive is partially variable or switchable, a closing time of an inlet valve and/or an inlet valve lift may be varied, thereby making throttling-free and thus loss-free load control possible. The charge air mass which flows into the combustion chamber during an air intake process may be controlled by means of an inlet valve lift and an opening duration of the inlet valve. Since fully variable valve drives may be expensive, partially variable or switchable valve drives may be attractive. Within the context of the present invention, switchable valve drives are regarded as partially variable valve drives. The engine to which the present invention relates may also have at least one at least partially variable valve drive. In this case, a hydraulic actuating device of a partially variable or switchable drive may be considered an example of an engine component receiving oil from the oil circuit.

Another engine component receiving engine oil from the oil circuit may include a hydraulic camshaft adjuster. The camshaft adjuster may be configured to adjust the cams of the camshaft relative to the crankshaft, thereby shifting, i.e. modifying, the valve timing. In the case of a two-part camshaft, a camshaft adjuster may also serve to adjust the inner camshaft relative to the outer camshaft, and hence adjust the cams of the inner camshaft, but not the cams of the outer camshaft, relative to the crankshaft. A further example of an engine component in the above-stated sense may include a hydraulic valve play compensation system of a valve or the oil spray cooling system of a piston belonging to the cylinder.

In contrast, a filter provided in the oil circuit or a pump provided in the oil circuit may not require high oil pressure for operation, and may be considered accessories of the oil circuit. The pressure in the oil circuit may vary based on engine operating conditions. As an example, the oil pressure may change based on engine load and speed. In a case of a non-variable oil pump, a relatively high oil pressure may prevails during high engine loads and high engine speeds, and a low oil pressure may prevail during low engine loads and low engine speeds.

Referring to FIG. 1, a schematic showing a section through a cylinder head assembly 100 of an internal combustion engine having an oil supply circuit 102 is disclosed. The oil supply circuit 102 includes a rising oil line 106, oil lines 110-116, a main oil line 120 and oil supply ducts 118A-118B. The rising oil line 106 is fluidly coupled to oil lines 110-116 and the main oil line 120, thereby allowing continuous flow of engine oil from the oil pan to various engine components. The cylinder head 100 may include an assembly side 103 and a non-assembly side 105.

As shown in FIG. 1, the cylinder head 100 is supplied with engine oil originating from an oil pan (not shown) via rising line 106 of the oil circuit 102. The engine oil may enter the rising line 106 of the oil circuit 102, as shown by arrow 104. The engine oil may be delivered into the rising line 106 from the oil pan using an oil pump (not shown), which may be a variable or non-variable displacement pump. The rising line 106 enters the cylinder head 100 on the assembly side 103, wherein the rising line 106 may be aligned perpendicularly to the assembly side 103 and parallel to cylinders (not shown) mounted within a cylinder block (not shown), which may be attached to the cylinder head 100. As an example, the rising line 106 may be a rectilinear line, and may be formed by drilling a passage through the cylinder head 100. The pump flowing engine oil from the oil pan into the rising line 106 may be a variable displacement oil pump or a variable displacement oil pump, but is preferably a non-variable displacement oil pump. In the case of a non-variable displacement oil pump, a high oil pressure may prevail in the oil circuit during high engine loads and high engine speeds, and a low oil pressure may prevail in the presence of low engine loads and low engine speeds. Examples of the non-variable displacement and variable displacement oil pumps used to flow engine oil into the oil circuit may include vane-type pumps and piston pumps.

The rising line 106 supplies engine oil to the main oil line 120 via oil lines 110-116 mounted within the cylinder head 100. The main oil line 120 may be mounted in the cylinder head 100 in a parallel direction to the assembly side 103, and parallel to a longitudinal axis of the cylinder head 100. The main oil line 120 may be a rectilinear line, formed by drilling a flow passage through a portion of the cylinder head 100. In this example, oil supply ducts 118A-118B may be provided along the main oil line 120. Each of the oil supply ducts 118A-118B, may lead to a camshaft bearing assembly and a hydraulic valve play compensation system, for example. A first plug 108 may be provided to seal a first end 109 of the oil supply circuit 102. Similarly, a second plug 122 may be provided to seal a second end 124 of the oil supply circuit 102.

A siphon system 119 serving as an oil retention reservoir is formed by oil lines 112-116, positioned between the rising line 106 and the main oil line 120. As an example, the siphon system 119, may be u-shaped design having vertical oil lines 112 and 116, each oil line 112 and 116 connected to a horizontal oil line 114. The oil line 112, may be formed adjacent to the rising line 106, and may have a section which is geodetically higher than the oil line 116, which may be formed adjacent to the main oil line 120. Both oil lines 112 and 116 may be initially formed as ducts open at the assembly side 103 of the cylinder head 100. Each oil line 112 and 116 may be formed by drilling a passage through the cylinder head 100. In order to form a leakage-free closed siphon system 119, a cylinder block and a seal may be provided at the assembly side 103 of the cylinder head 100. As an example, the seal may be positioned between the cylinder head 100 and the cylinder block.

When installed, oil line 114 of the siphon system 119 may lie in a flat plane parallel to the assembly side 103. The siphon system 119 may have a section which is geodetically lower than a section of the rising line 106 and geodetically lower than a section of the main oil line 120. This ensures that the siphon system 119 retains a portion of the engine oil when the engine is switched off. As an example, the portion of the engine oil may partially or fully fill oil lines 112-116, when the engine is switched off. The main oil line 120 may retain a portion of the engine oil when the engine is switched off. In this case, oil pressure in the main oil line 120 may be increased, i.e. raised immediately when the engine is restarted. In this way, engine components may immediately receive engine oil from the main oil line 120, and system oil pressure may be increased without delay during engine startup, thereby improving engine performance.

Referring to FIG. 2, a three dimensional schematic of a cylinder head 200 having an oil circuit 202 and a cylinder 270 is disclosed. The oil circuit 202 includes a rising oil line 206, oil lines 210-216, a main oil line 218, and a plurality of oil supply ducts 207 and 220. The rising oil line 206 is fluidly coupled to oil lines 210-216 and the main oil line 218, thereby allowing flow of engine oil from the oil pan to various components of the engine. The cylinder head 200 may include a first side 203 and a second side 205. A cylinder block 260 may be mounted to the first side 203 of the cylinder head 200, and secured using a fastener extended through an opening 252. The cylinder block may include a plurality of cylinders, a crankshaft 262 supported by bearings 264, and other engine components. A lower crankcase 266, which includes the oil pan, may be mounted to a bottom portion of the cylinder block 260. An upper crankcase (not shown) may be mounted to the second side 205 of the cylinder head 200, for example. The cylinder head 200 may also include a side portion 217 and an external wall 211. The side portion 217 may include a curved section 246, a rib section 248, and a recessed slot 250. The curved section 246 may include a flow passage 238, which may be fluidly coupled to the oil circuit 202. The oil circuit 202 may supply engine oil to various engine components via a plurality of flow passages 226-238. The flow passage 234, connected to engine component 242, may include a flow duct 240. A coolant line 244, positioned adjacent to the engine component 242, may be provided in the cylinder head 200 to cool the engine.

As shown in FIG. 2, cylinder head 200 may receive engine oil from the oil pan via the rising line 206. The engine oil from the oil pan may enter the rising line 206 as shown by arrow 204. As an example, the engine oil may be delivered to the rising line 206 from the oil pan using an oil pump 268. In one example, the oil pump may be positioned in the oil pan to deliver engine oil to the rising line 206, where the engine oil is further flowed to other sections of the oil circuit 202. The rising line 206 may enter the cylinder head 200 on the first side 203, wherein the rising line 206 may be aligned perpendicularly to the first side 203 and parallel to cylinders (not shown) mounted in the cylinder block 260 positioned below the cylinder head 200. As an example, the rising line 206 may be rectilinear, and may be formed by drilling a flow passage through the cylinder head 200. The rising line 206 is fluidly coupled to oil line 210, which in turn may be fluidly coupled to a first oil supply duct 207 on one end and coupled to an oil siphon system 215 on another end. The first oil supply duct 207 may connect to a camshaft bearing assembly or a hydraulic valve play compensation system, for example. As an example, the first oil supply duct 207 may deliver engine oil to the camshaft bearing assembly or hydraulic valve play compensation system, as shown by arrow 213. A first plug 208 may be provided to seal a first end 209 of the oil circuit 202.

The oil siphon system 215 may include oil lines 212-216, coupled to one another to form a continuous conduit, fluidly coupled to the rising line 206 on one end, and coupled to the main line 218 at another end. The siphon system 215 may serve as an oil retention reservoir for engine oil within the oil circuit 202. As an example, the oil lines 212-216 of the oil siphon system 215 may be positioned between the rising line 206 and the main oil line 218. The oil siphon system 215, may be a u-shaped pipe network having oil lines 212-216, fluidly coupled to the rising line 206 and main oil line 218, for example. In one example, the oil lines 212 and 216 may be vertical while the oil line 214 may be horizontal. The oil line 212, may be formed adjacent to the rising line 206, and may have a section which is geodetically higher than the oil line 216, which may be formed adjacent to the oil line 218. Both oil lines 212 and 216 may be initially formed as ducts open at the first side 203 of the cylinder head 200. Each oil line 212 and 216 may be formed by drilling a flow passage through the cylinder head 200. In order to ensure that the oil siphon system 215 is a leakage-free closed system, the cylinder block and a sealing gasket (not shown) may be provided at the first side 203 of the cylinder head 200. The sealing gasket may be positioned between the cylinder head 200 and the cylinder block to minimize leakage of oil or other fluids from the cylinder head.

The oil line 216 of the oil siphon system 215 may be fluidly coupled to the main oil line 218, which in turn may be coupled to a second oil supply duct 220. In this way, the engine oil from the rising line 206 may reach the main oil line 218 via oil lines 210-216 of the oil siphon system 215. The second oil supply duct 220 may be fluidly coupled to a camshaft bearing assembly or a hydraulic valve play compensation system, thereby providing engine oil to both systems (as shown by arrow 222), during engine operation. The main oil line 218 may be mounted in the cylinder head 200 in a parallel direction to the first side 203, and also parallel to a longitudinal axis 225 of the cylinder head 200. The main oil line 218 may be rectilinear and formed by drilling a passage through a portion of the cylinder head 200. A second plug 224 may be provided to seal an outer end of the main oil line 218.

When installed, the oil line 214 of the oil siphon system 215 may lie in a flat plane parallel to the first side 203 of the cylinder head 200. The oil siphon system 215 may have a section which is geodetically lower than a section of the rising line 206, and geodetically lower than a section of the oil line 218. In this way, the oil siphon system 215 may retain a portion of the engine oil when the engine is turned off. As an example, the portion of the engine oil may partially or fully fill oil lines 212-216, when the engine is switched off. The portion of the engine oil retained in the oil siphon system 215 may form a continuous column with a portion of oil retained in the oil line 218, when the engine is switched off. In this case, oil pressure in the main oil line 218 may be increased immediately when the engine is started. In this way, engine components may immediately receive engine oil from the main oil line 218, and system oil pressure may be increased without delay during engine startup, thereby improving engine performance.

Further advantageous embodiments of the engine according to the invention will be explained in conjunction with the claims. Embodiments of the engine are advantageous in which an oil pan which may be mounted on the upper crankcase, and may serves as a lower crankcase for storing engine oil. Furthermore, embodiments of the engine are advantageous in which the pump is at least connectable to the oil pan in order to deliver engine oil originating from the oil pan to the main oil gallery via a supply line. In said embodiment, the crankcase may be formed in two parts, with the upper crankcase being complemented by an oil pan which retains engine oil. As an example, an external portion of the oil pan may have cooling fins or stiffening ribs, and the pan may be preferably produced from sheet metal in a deep drawing process, while the upper crankcase may be preferably a cast component. In a further example, the crankcase may be configured with a threshold level of rigidity that reduces vibrations, thereby minimizing noise generation and emission from the engine. In other examples, the crankcase, of modular design, may be constructed in such a manner that the machining of assembly and sealing surfaces may be conducted with simple means while minimizing costs.

Embodiments of the internal combustion engine are advantageous in which an additional pump is arranged in the oil circuit. The additional pump may complement or operate in conjunction with the oil pump. The pumps may be arranged either in series or in parallel, for example. In this case, both pumps may be operated to the increase of oil pressure in the oil circuit and ensure reliable delivery of the oil to the oil circuit. In particular, the additional pump may be provided in the rising line in order to supply oil to particular engine components mounted to the cylinder head. As an example, the particular engine components may be indispensable for proper and reliable functioning of the engine, such as a hydraulic actuating device of a valve drive.

Embodiments of the internal combustion engine are advantageous in which the oil line belonging to the oil circuit is aligned substantially parallel to the assembly side of the cylinder head. In engines in which a cylinder head has at least two cylinders arranged along a longitudinal axis of the cylinder head, embodiments are advantageous in which the oil line of the oil circuit is aligned substantially parallel to the longitudinal axis of the cylinder head. However, embodiments of the engine may also be advantageous in which the oil line of the oil circuit is aligned substantially perpendicularly to the longitudinal axis of the cylinder head. Embodiments of the engine are advantageous in which the rising line of the oil circuit branches off from the oil circuit within the cylinder block. Embodiments of the engine are advantageous in which the rising line of the oil circuit branches off from a main oil gallery. Embodiments of the engine may also be advantageous in which the rising line of the oil circuit leads to the oil pan. Optionally, an additional pump may be provided in the rising line. Embodiments of the engine are advantageous in which the rising line of the oil circuit may be aligned substantially perpendicularly to the assembly side of the cylinder head. Embodiments of the engine are advantageous in which the rising line of the oil circuit may be aligned substantially parallel to the at least one cylinder of the at least one cylinder head.

Embodiments of the engine are advantageous in which a siphon system serving as an oil retention reservoir has a u-shaped section, which has two leg-like ducts connected to one another via a central piece. According to this embodiment, the siphon system, may counteract drainage of oil from the oil circuit, and may offers numerous advantages. In this connection, embodiments of the engine are advantageous in which a first leg-like duct arranged on the same side as the rising line has, in an installation position of the siphon system within the engine, a section which is geodetically higher than a second leg-like duct arranged on the same side as the oil line. This embodiment takes account of the fact that the drainage of the oil when the intern engine is switched off is gravity-driven, and it is therefore advantageous if the entry to the rising line, as seen from the standpoint of oil drainage, is geodetically higher than the oil line adjoining the siphon system or second leg-like duct on a downstream side. In further embodiments of the engine, at least one of the two leg-like ducts may be designed as a duct which is originally open toward the assembly side of the cylinder head, and is closed to form a leakage-free oil siphon system. At least one leg-like duct of the siphon system may be formed by casting or drilling. This may simplify component manufacture while reduce costs.

Embodiments of the engine are advantageous in which at least one of the two leg-like ducts is designed as a duct which is originally open toward the assembly side and is closed to form a leakage-free siphon system using the cylinder block and/or a seal. Additional component parts or components for closing one leg are eliminated or are not required to form a leakage-free siphon system. In this connection, embodiments of the engine may be advantageous in which the rising line of the oil circuit and/or at least one of the two leg-like ducts of the siphon system are formed by means of drilling. Embodiments of the engine are likewise advantageous in which the rising line of the oil circuit and/or at least one of the two leg-like ducts of the siphon system are formed by means of casting.

A further embodiment may comprise: delivering oil to a cylinder head of an engine through a rising oil line coupled to an engine block; delivering oil to various engine components in the engine head through a main oil line which receives oil from an oil siphon system which is connected between the rising and main oil lines, the oil siphon system including an oil retention reservoir having sections at a lower elevation than sections of the main and rising oil lines; and draining oil from the main oil line into the oil retention reservoir when the engine is shut-off and retaining oil in at least the oil retention reservoir until start of the engine. In a preceding embodiment, the oil retention system is essentially u-shaped having two columns and a connecting leg and retaining oil in the columns and leg when the engine is shut-off. In yet another embodiment, the retained oil achieves desired oil pressure immediately upon start of the engine so that oil is delivered to the engine components without delay upon engine start.

In the case of engines in which at least a partially variable valve drive is provided, embodiments are advantageous in which the oil line supplies engine oil to at least one at least partially variable valve drive. In this connection, embodiments of the engine are advantageous in which the oil line supplies engine oil to a hydraulically adjustable actuating device of at least one at least partially variable valve drive. In this connection, a camshaft adjuster is regarded as belonging to the valve drive, specifically as being part of the actuating device. In the case of engines in which at least one cylinder is fitted with a hydraulic valve play compensation system, embodiments are advantageous in which the oil line supplies engine oil to at least one hydraulic valve play compensation system. The above embodiments relate to critical engine components that are indispensable for reliable functioning of the engine, such as the hydraulic actuating device of a valve drive. The provision of the siphon system according to the invention ensures that the critical engine components are supplied with oil or are charged with a sufficiently high oil pressure, preferably without interruption.

FIGS. 1-2 show example configurations with relative positioning of the various components of the oil circuit for the internal combustion engine. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

a rising oil line from a cylinder block to a cylinder head of an engine;

a main oil line in the cylinder head; and an oil siphon system including a reservoir positioned between, and having at least one portion at a lower elevation than both a section of the rising oil line and a section of the main oil line so that oil flows into, and remains in, the reservoir when the engine is shut-off;

wherein the rising oil line extends through the cylinder head and supplies oil to the main oil line; and wherein the reservoir is positioned entirely within the cylinder head and wherein the reservoir extends horizontally across the cylinder head.

2. The system of claim 1, wherein the rising oil line, the main oil line, and the oil siphon system are a sealed system.

3. The system of claim 1, further comprising an oil pump coupled to the rising oil line.

4. The system of claim 1, wherein oil remains in the reservoir and at least a portion of the main oil line and a portion of the rising oil line after the engine is shut-off.

5. The system of claim 1, wherein the main oil line provides oil to one or more engine components including one or more of a valve train, a variable valve drive, a camshaft, and a camshaft adjuster.

6. The system of claim 5, wherein the one or more engine components receive oil upon engine start without an interruption in oil delivery.

7. The system of claim 1, wherein the oil siphon system and the reservoir form a u-shape connection between the rising oil line and the main oil line.

8. A system, comprising:

an internal combustion engine having at least one cylinder head with at least one cylinder;

a cylinder block serving as an upper crankcase for accommodating a crankshaft in at least two bearings, wherein the cylinder block is connected to the at least one cylinder head on an assembly side; and a pump for delivering engine oil to the at least two bearings, wherein the pump supplies the engine oil via a supply line to a main oil gallery from which a plurality of ducts lead to the at least two bearings, forming an oil circuit;

wherein the oil circuit has a rising line which leads into the at least one cylinder head and supplies the engine oil to a main oil line extending in the at least one cylinder head;

wherein a siphon system serving as an oil retention reservoir is provided entirely within the at least one cylinder head between the rising line and the main oil line and wherein the oil retention reservoir extends horizontally across the at least one cylinder head; and wherein the siphon system has at least an oil line mounted in an installation position within the internal combustion engine in which the assembly side is inclined by an angle relative to a horizontal plane, and at least one section of the siphon system is positioned at a geodetically lower elevation than a section of the rising line and at a geodetically lower elevation than a section of the main oil line.

9. The system as claimed in claim 8, wherein an oil pan, which is mounted on the upper crankcase and which serves as a lower crankcase, is provided for collecting the engine oil.

10. The system as claimed in claim 8, wherein the main oil line of the oil circuit is aligned parallel to the assembly side.

11. The system as claimed in claim 8, wherein the at least one cylinder head has at least two cylinders, which are arranged along a longitudinal axis of the at least one cylinder head, and wherein the main oil line of the oil circuit is aligned parallel to the longitudinal axis of the at least one cylinder head.

12. The system as claimed in claim 8, wherein the rising line of the oil circuit branches off from the main oil gallery in the cylinder block.

13. The system as claimed in claim 8, wherein the siphon system serving as the oil retention reservoir has a u-shaped section, which has two leg-like ducts connected to one another via a central piece.

14. The system as claimed in claim 13, wherein a first leg-like duct arranged on a same side as the rising line has, in the installation position of the engine, a section which is geodetically higher than a second leg-like duct arranged on a same side as the main oil line.

15. The system as claimed in claim 13, wherein at least one of the two leg-like ducts is designed as a duct which is originally open toward the assembly side and is closed to form a leakage-free siphon system.

16. The system as claimed in claim 13, wherein at least one of the two leg-like ducts is designed as a duct which is originally open toward the assembly side and is closed to form a leakage-free siphon system using the cylinder block and/or a seal.

17. A method, comprising:

delivering oil to a cylinder head of an engine through a rising oil line coupled to an engine block, extending through a cylinder head, and supplying oil to a main oil line;

delivering oil to a plurality of engine components in the cylinder head through the main oil line which receives oil from an oil siphon system which is connected between the rising oil line and the main oil line, wherein the oil siphon system includes an oil retention reservoir having a section at a lower elevation than a section of each of the main oil line and the rising oil line, wherein the oil retention reservoir is positioned entirely within the cylinder head; and draining oil from the main oil line into the oil retention reservoir when the engine is shut-off and retaining oil in at least the oil retention reservoir until a start of the engine;

wherein the oil retention reservoir extends horizontally across the cylinder head.

18. The method of claim 17, wherein the oil retention reservoir is u-shaped and includes two columns and a connecting leg, and retains oil in the two columns and the connecting leg when the engine is shut-off.

19. The method of claim 17, wherein the retained oil achieves a desired oil pressure immediately upon the start of the engine so that the oil is delivered to the plurality of engine components without delay upon the start of the engine.

* * * * *